US011435775B2

(12) United States Patent
Korherr et al.

(10) Patent No.: US 11,435,775 B2
(45) Date of Patent: Sep. 6, 2022

(54) MAGNETIC ROTARY DIAL AND MOTOR VEHICLE OPERATING UNIT

(71) Applicant: BCS AUTOMOTIVE INTERFACE SOLUTIONS GMBH, Radolfzell (DE)

(72) Inventors: Joachim Korherr, Orsingen (DE); Simon Johler, Tettnang (DE)

(73) Assignee: BCS AUTOMOTIVE INTERFACE SOLUTIONS GMBH, Radolfzell (DE)

( * ) Notice: Subject to any disclaimer, the term of this patent is extended or adjusted under 35 U.S.C. 154(b) by 0 days.

(21) Appl. No.: 17/279,262

(22) PCT Filed: Oct. 9, 2019

(86) PCT No.: PCT/EP2019/077402
§ 371 (c)(1),
(2) Date: Mar. 24, 2021

(87) PCT Pub. No.: WO2020/074605
PCT Pub. Date: Apr. 16, 2020

(65) Prior Publication Data

US 2022/0066496 A1 Mar. 3, 2022

(30) Foreign Application Priority Data

Oct. 10, 2018 (DE) ..... 10 2018 125 077.0

(51) Int. Cl.
*G05G 1/08* (2006.01)
*G05G 5/06* (2006.01)
*H01F 7/02* (2006.01)

(52) U.S. Cl.
CPC ..... *G05G 5/06* (2013.01); *G05G 1/08* (2013.01); *H01F 7/02* (2013.01)

(58) Field of Classification Search
None
See application file for complete search history.

(56) References Cited

U.S. PATENT DOCUMENTS

| | | | |
|---|---|---|---|
| 4,647,889 | A | 3/1987 | Addis |
| 8,138,866 | B2 | 3/2012 | Kramlich et al. |
| 9,093,237 | B2 | 7/2015 | Bondar |
| 9,630,499 | B2 | 4/2017 | Blaesing et al. |
| 2002/0056321 | A1 | 5/2002 | Fallak |

(Continued)

FOREIGN PATENT DOCUMENTS

| | | | |
|---|---|---|---|
| DE | 19922638 | A1 | 11/2000 |
| DE | 20220379 | U1 | 7/2003 |

(Continued)

*Primary Examiner* — Richard W Ridley
*Assistant Examiner* — Brian J McGovern
(74) *Attorney, Agent, or Firm* — McNees Wallace & Nurick LLC

(57) ABSTRACT

A magnetic rotary actuator (12) for a motor vehicle control unit (10) is described, including a stationary part (22) and a rotary member (18) which is rotatable relative to the stationary part (22). The magnetic rotary actuator (12) has a magnetic latching haptics (28) comprising a plurality of magnetic latching positions. Both the stationary part (22) and the rotatable rotary member (18) each comprise at least two separately formed magnetic elements (30) which cooperate to generate the plurality of magnetic latching positions. A motor vehicle control unit (10) is furthermore described.

11 Claims, 1 Drawing Sheet

(56) References Cited

U.S. PATENT DOCUMENTS

| | | | | |
|---|---|---|---|---|
| 2007/0267283 | A1* | 11/2007 | Hiroe | H01H 5/02 200/179 |
| 2016/0070275 | A1* | 3/2016 | Anderson | H04H 60/04 700/275 |
| 2016/0176292 | A1* | 6/2016 | Blaesing | G06F 3/0412 335/219 |
| 2017/0090572 | A1* | 3/2017 | Holenarsipur | G06F 3/0362 |

FOREIGN PATENT DOCUMENTS

| | | | |
|---|---|---|---|
| DE | 10304804 | A1 | 8/2003 |
| DE | 202008013517 | U1 | 12/2008 |
| EP | 2159455 | A1 | 3/2010 |
| FR | 2908903 | A1 | 5/2008 |

* cited by examiner

MAGNETIC ROTARY DIAL AND MOTOR VEHICLE OPERATING UNIT

RELATED APPLICATIONS

This application filed under 35 U.S.C § 371 is a national phase application of International Application Serial Number PCT/EP2019/077402, filed Oct. 9, 2019, which claims the benefit of German Application No. 10 2018 125 077.0 filed Oct. 10, 2018, the subject matter of which are incorporated herein by reference in their entirety.

BACKGROUND

The invention relates to a magnetic rotary dial for a motor vehicle operating unit (also called magnetic rotary actuator for a motor vehicle control unit). The invention further relates to a motor vehicle control unit for a motor vehicle.

Motor vehicle control units having a rotary knob are known from the prior art, the rotary knob outputting a haptic feedback to the operator when he/she accordingly actuates, i.e. rotates the rotary knob. The operator of the motor vehicle control unit is thus given a corresponding operating feeling such that he/she can feel in which position the rotary knob is.

Such motor vehicle control units are for example used for heating, ventilation and/or air-conditioning devices (HVAC), multimedia systems, and generally for vehicle control systems.

It is furthermore known from the prior art that the motor vehicle control units comprise so-called magnetic rotary actuators which are assigned to the rotary knobs. In the magnetic rotary actuators, the haptic feedback is generated magnetically, which is also referred to as magnetic latching haptics. The advantage of the magnetic latching haptics or the magnetic feedback in comparison with mechanical rotary actuators consists in that no or hardly any noise occurs and furthermore there is no mechanical wear.

To this end, the magnetic rotary actuator usually comprises a rotatable rotary actuator having a magnet which interacts with a plurality of stationary magnets to be able to form the corresponding latching positions.

However, if the magnetic latching haptics is intended to comprise several latching positions, an appropriate number of magnets must be provided, as a result of which the required installation space of the magnetic rotary actuator is correspondingly high.

SUMMARY

The object of the invention is to provide a simply structured rotary actuator which comprises several magnetic latching positions.

According to the invention, the object is achieved by a magnetic rotary actuator for a motor vehicle control unit, including a stationary part and a rotary member which is rotatable relative to the stationary part, the magnetic rotary actuator having a magnetic latching haptics comprising a plurality of magnetic latching positions, and both the stationary part and the rotatable rotary member each comprising at least two separately formed magnetic elements which cooperate to generate the plurality of magnetic latching positions.

The basic idea of the invention is that the magnetic rotary actuator can be configured more compact as both the stationary part and the rotatable rotary member each comprise at least two magnetic elements such that several latching positions can be defined in comparison with a magnetic rotary actuator, the rotary member of which includes only one magnet.

Both the stationary part and the rotatable rotary member in particular have a plurality of magnetic elements which are each arranged such that as many magnetic latching positions as possible can be produced.

In particular, the magnetic elements each have a south pole and a north pole, the magnetic elements on the rotatable rotary member and the magnetic elements on the stationary part being respectively oriented with different poles to each other. Therefore, the south poles of the magnetic elements of the rotary member face the north poles of the magnetic elements on the stationary part, or vice versa. It is thus ensured that the respective magnetic elements can interact with each other to form the corresponding latching positions of the rotary actuator.

Basically, a complete magnetic interaction is produced if two magnetic elements directly face each other, i.e. with different poles, such that a maximum magnetic interaction is produced between the two magnetic elements. The two magnetic elements are a magnetic element arranged on the stationary part and a magnetic element provided on the rotatable rotary member.

The movement of the rotatable rotary member relative to the stationary pert is thus made more difficult as the magnetic forces between the two magnetic elements hold the rotatable rotary member in the corresponding latching position, thereby producing the magnetic latching haptics.

One aspect provides that in each magnetic latching position, only one magnetic element of the rotatable rotary member entirely contributes to the latching location of the rotary actuator in the corresponding magnetic latching position. This means that only one magnetic element of the at least two magnetic elements of the rotatable rotary member directly faces a magnetic element on the stationary part. The only one magnetic element of the rotatable rotary member in particular cooperates with exactly one magnetic element of the stationary part to cause the latching location of the rotary actuator. It is therefore accordingly ensured that the several magnetic elements produce the greatest possible number of magnetic latching positions for the rotary actuator.

Basically, the rotary member may be coupled to an actuating element, in particular via a rotary shaft. The actuating element may be an actuating or rotary knob which is actuated or rotated by an operator of the motor vehicle control unit, which is transmitted via the rotary shaft to the rotary member which rotates relative to the stationary part. Due to the rotary motion, the magnetic elements arranged on the rotatable rotary member move along the magnetic elements which are arranged in a stationary manner and are coupled to the stationary part. A corresponding magnetic interaction is therefore produced which is perceived as magnetic latching haptics by the operator.

A further aspect provides that the number of magnetic latching positions is equal to the product of the number of magnetic elements provided on the rotatable rotary member and the number of magnetic elements provided on the stationary part. In other words, M magnetic elements could be provided on the stationary part, whereas N magnetic elements are provided on the rotatable rotary member, such that a number of magnetic latching positions is obtained which is M×N. In this respect, a maximum number of magnetic latching positions is obtained with the available magnetic elements.

According to one embodiment, the at least two magnetic elements are arranged equidistantly to each other on the stationary part. This means that they respectively have the same distance from each other. If more magnetic elements, in particular more than two magnetic elements are provided on the stationary part, it results therefrom that the corresponding magnetic elements each have the same distance from each other so as to be evenly distributed.

Generally, the distance is an angular separation which may also be referred to as angular distance, radian measure or arc length.

According to a further aspect, the at least two magnetic elements on the rotatable rotary member are spaced differently from each other. In the case of two magnetic elements, this means that they do not exactly face each other, but are arranged offset to each other, such that the relative distance in one direction is larger than the relative distance in the other direction. The arc length in one direction is, for example, $\frac{3}{4}*\pi*r$, whereas the distance in the other direction is $5/4*\pi*r$. If several magnetic elements are provided on the rotatable rotary member, in particular more than two magnetic elements, it results therefrom that the magnetic elements each have different distances from each other.

In principle, more magnetic elements could be provided on the stationary part than on the rotatable rotary member. The rotatable rotary member may be surrounded by the stationary part such that the radius of the rotatable rotary member is smaller than that of the stationary part if the latter is configured to be round. Less space for the magnetic elements is thus produced on the rotatable rotary member, as a result of which the number of magnetic elements on the rotatable rotary member is usually correspondingly smaller.

For the rotatable rotary member, it is in particular provided that adjacent magnetic elements are respectively spaced differently from each other. In contrast thereto, the magnetic elements on the stationary part are arranged equidistantly to each other.

It may be provided that adjacent magnetic elements on the rotatable rotary member each have an angular distance from each other which is limited upwards by an upper limit angle which is calculated as follows $$\frac{360°}{N} + \frac{360°}{N^2},$$

and which is limited downwards by a lower omit angle, which is calculated as follows $$\frac{360°}{N} - \frac{360°}{N^2},$$

N being the number of magnetic elements on the rotatable rotary member. This however also depends on the arrangement of the magnetic elements on the stationary part.

In case of N=3 magnetic elements on the rotatable rotary member, angular distances between 80° and 160° are thus obtained for adjacent magnetic elements.

In case of N=4 magnetic elements on the rotatable rotary member, angular distances between 67.5° and 112.5° are thus obtained for adjacent magnetic elements.

In case of N=5 magnetic elements on the rotatable rotary member, angular distances between 57.6° and 66.4° are thus obtained for adjacent magnetic elements.

In case of N=6 magnetic elements on the rotatable rotary member, angular distances between 50° and 70° are thus obtained for adjacent magnetic elements.

The different angular distances of the adjacent magnetic elements could respectively be different from each other.

Via the appropriately selected angular distances, it is ensured that only one magnetic element of the rotatable rotary member contributes maximally or entirely to the latching location of the rotary member, whereas the magnetic interaction of the other magnetic elements on the rotatable rotary member is minimized as far as possible.

Therefore, precisely no latching force increase is provided, in which two magnetic elements of the rotary member or of the stationary part are simultaneously active in a latching position.

Rather, a maximum number of magnetic latching positions can be produced in a simple manner, which are as clearly distinguishable from each other as possible, i.e. with the lowest interference effects.

It can furthermore be provided that the stationary part is a magnetic housing which radially surrounds the rotatable rotary member. The rotatable rotary member is thus surrounded by the stationary part, as a result of which it is accordingly protected. Furthermore, a lower rotating mass is produced, the operation of the rotary actuator being thus accordingly easier and more comfortable for the operator.

The magnetic elements are in particular respectively formed by bar magnets and/or by at least one magnetic ring. The bar magnets are permanent magnets, the ends of which provide the south and the north pole. A simple structure of the magnetic rotary actuator is thus ensured. The at least one magnetic ring may be a magnetic ring having a multipolar magnetization to provide the corresponding magnetic elements. The magnetic ring having the multipolar magnetization can be produced in a specific magnetization device such that it comprises the several magnetizations, via which the magnetic elements are accordingly produced.

According to the invention, the object is further achieved by a motor vehicle control unit which comprises a magnetic rotary actuator of the previously mentioned type. The advantages mentioned above are thus achieved in an analogous manner for the motor vehicle control unit.

The magnetic elements are in particular arranged in a common plane.

BRIEF DESCRIPTION OF THE DRAWINGS

Further advantages and properties of the invention will become apparent from the description below and from the drawings to which reference is made and in which.

DETAILED DESCRIPTION

Figure 1:
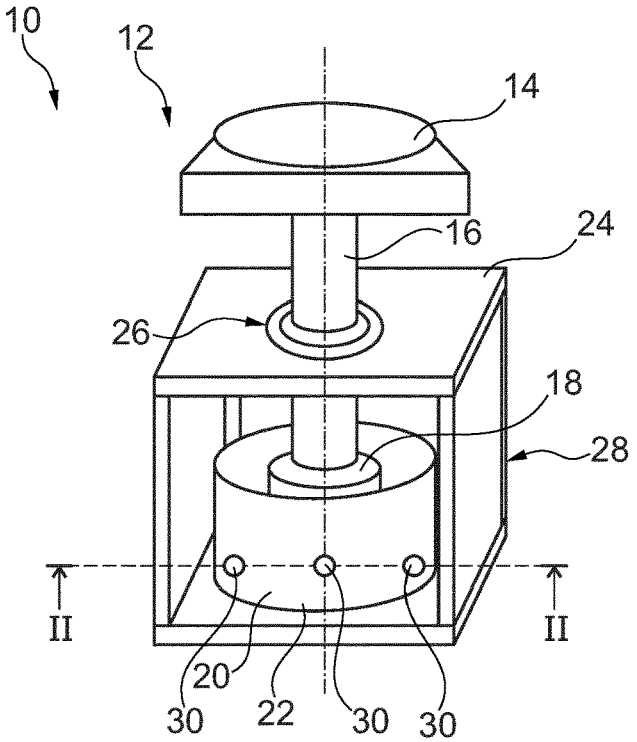
FIG. 1 shows a schematic representation of a motor vehicle control unit according to the invention including a magnetic rotary actuator according to the invention.

FIG. 1 shows a motor vehicle control unit 10 for a motor vehicle, which comprises a magnetic rotary actuator 12 which can be operated by an operator or a vehicle occupant to set a function of the motor vehicle control unit 10.

The motor vehicle control unit 10 may be a control unit for a heating, ventilation and/or air-conditioning device (HVAC) of the motor vehicle or a multimedia device of the motor vehicle.

In the embodiment shown, the magnetic rotary actuator 12 comprises an actuating element 14, which is configured as a rotary knob and is coupled via a rotary shaft 16 to a rotatable rotary member 18 which is radially surrounded by a stationary part 22 configured as a magnetic housing 20.

The magnetic rotary actuator 12 furthermore comprises a housing 24 which is illustrated partially transparent in FIG. 1.

The stationary part 22 and the rotatable rotary member 18 which are visible due to the partially transparent illustration are both arranged in the housing 24.

In contrast thereto, the actuating element 14 is provided outside the housing 24 so that it can accordingly be controlled by the operator. In this respect, the rotary shaft 16 extends through an opening 26 in the housing 24 to the rotary member 18 to transmit the rotary motion to the rotary member 18. The opening 26 may be sealed such that no dirt can enter the housing 24.

It is already apparent from FIG. 1 that the magnetic rotary actuator 12 has a magnetic latching haptics 28 comprising a plurality of magnetic latching positions in which a magnetic force holds the rotary actuator 12 in the corresponding position, as will be discussed below with reference to FIG. 2.

The magnetic latching haptics 28 is formed by a plurality of magnetic elements 30 which are arranged on the stationary part 22, as is already apparent from FIG. 1.

Figure 2:
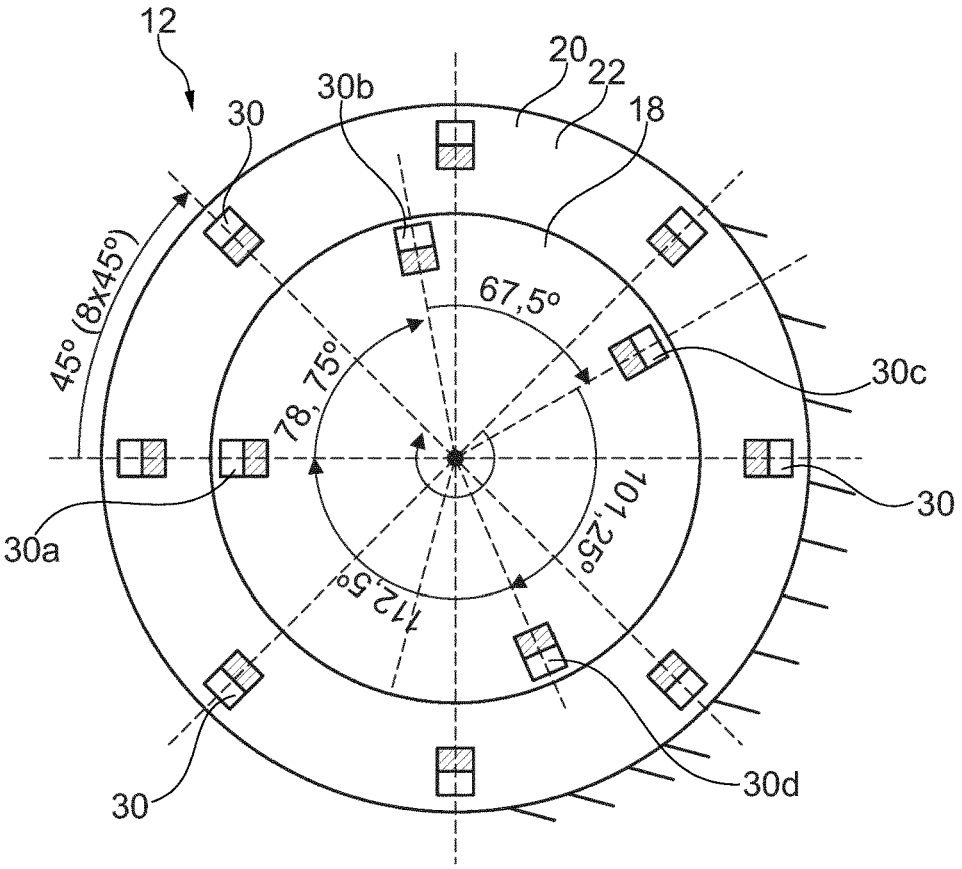
FIG. 2 shows a sectional representation through the magnetic rotary actuator shown in FIG. 1 along II-II.

The magnetic elements 30 are furthermore also provided on the rotatable rotary member 18, as is apparent from FIG. 2 which shows a sectional view of FIG. 1 along II-II.

The magnetic elements 30 provided on the stationary part 22 and on the rotatable rotary member 18 interact with each other to generate the plurality of magnetic latching positions in which the rotary actuator 12 can remain if a lower force than the magnetic force of the interacting magnetic elements 30 is exerted upon rotary actuation of the actuating element 14.

To this end, the magnetic elements 30 are oriented with different poles to each other, the south poles of the magnetic elements 30 provided on the rotatable rotary member 18, for example, pointing radially outwards, whereas the north poles of the magnetic elements 30 provided on the stationary part 22 point radially inwards such that the south poles and the north poles face each other, as shown in FIG. 2.

Alternatively, it may also be provided that the north poles of the magnetic elements 30 provided on the rotatable rotary member 18 point radially outwards, whereas the south poles of the magnetic elements 30 provided on the stationary part 22 point radially inwards, such that the north poles and the south poles face each other.

In the embodiment shown, the stationary part 22 comprises eight magnetic elements 30 which are respectively arranged equidistantly to each other. This means that the magnetic elements 30 which are provided on the stationary part 22 respectively have the same distance from each other. More specifically, the magnetic elements 30 each have an angular distance of 45° from each other.

Basically, the distance can be considered as radian measure, arc length or angular distance.

In the embodiment shown, the rotatable rotary member 16 further comprises four magnetic elements 30 which are each differently spaced from each other, as is also clearly apparent from FIG. 2.

The first magnetic element 30*a* and the second magnetic element 30*b* of the rotatable rotary member 18 are for example spaced apart from each other by an angle of 78.75°, whereas the second magnetic element 30*b* and the third magnetic element 30*c* are spaced apart from each other by an angle of 67.5°, whereas the third magnetic element 30*c* and the fourth magnetic dement 30*d* are in turn spaced apart from each other by an angle of 101.25°, whereas the fourth magnetic element 30*d* and the first magnetic element 30*a* are spaced apart from each other by an angle of 112.5°.

As already explained, the eight equidistantly spaced apart magnetic elements 30 on the stationary part 22 are however spaced apart by the same angle of 45°.

Generally, it can be determined that the adjacent magnetic elements 30 on the rotatable rotary member 18 have an angular distance from each other which is limited upwards by an angle $$\frac{360°}{N} + \frac{360°}{N^2},$$

and downwards by an angle $$\frac{360°}{N} - \frac{360°}{N^2},$$

N being the number of magnetic dements 30 on the rotatable rotary member 18.

Due to these differently spaced apart magnetic elements 30 on the rotatable rotary member 18, it is ensured that in each magnetic latching position, only one single magnetic element 30 of the rotatable rotary member 18 entirely contributes to the latching location of the rotary actuator 12, as is clearly apparent from FIG. 2.

Only the first magnetic element 30*a* cooperates there with exactly one magnetic element 30 on the stationary part 22.

In contrast thereto, the other magnetic elements 30*b*, 30*c*, 30*d* of the rotatable rotary member 18 are not directly assigned to any corresponding magnetic element 30 on the stationary part 22.

It is thus possible to correspondingly maximize the number of magnetic latching positions of the magnetic rotary actuator 12.

Due to the corresponding arrangement of the magnetic elements 30*a*-30*d* on the rotatable rotary member 18, a total of 32 magnetic latching positions can be obtained.

The number of latching positions corresponds to the product of the number of magnetic elements 30*a*-30*d* provided on the rotatable rotary member 18, namely four, and the number of magnetic elements 30 provided on the stationary part 22, namely eight. In this respect, the 32 magnetic latching positions of the rotary actuator 12 are obtained.

Generally speaking, the number of magnetic latching positions is equal to N×M, N being the number of magnetic elements 30 on the rotatable rotary member 18, and M being the number of magnetic elements 30 on the stationary part 22.

As the stationary part 22 radially surrounds the rotatable rotary member 18, the rotatable rotary member has a smaller radius than the stationary part 22 which furthermore must not necessarily have a circular shape. Due to the smaller radius of the rotatable rotary member 18, principally more magnetic elements 30 are provided on the stationary part 22 than on the rotatable rotary member 18, as correspondingly more space is available.

Basically, the magnetic elements 30 can each be formed by bar magnets and/or by at least one magnetic ring which comprises a multipolar magnetization. This is dearly apparent from FIG. 2.

Using the magnetic rotary actuator 12 according to the invention, it is thus ensured that a maximum number of magnetic latching positions can be provided, the structure of the rotary actuator 12 being accordingly compact.

This is obtained as both the stationary part 22 and the rotatable rotary member 18 each comprise a plurality of magnetic elements 30, only one magnetic element 30 of the rotatable rotary member 18 and only one magnetic element 30 of the stationary part 22 contributing to the latching location in each latching position.

The number of magnetic latching positions can be maximized as the magnetic elements 30 on the rotary rotating member 18 are respectively spaced differently from each other.

The invention claimed is:

1. A magnetic rotary actuator for a motor vehicle control unit, comprising:

a stationary part;

a rotary member which is rotatable relative to the stationary part; and a magnetic latching haptics including a plurality of magnetic latching positions, wherein the stationary part and the rotatable rotary member each includes at least two separately formed magnetic elements which generate the plurality of magnetic latching positions, and wherein for each magnetic latching position, only one magnetic element of the rotatable rotary member entirely contributes to the latching of the rotary actuator in the magnetic latching position.

2. The magnetic rotary actuator according to claim 1, wherein a number of magnetic latching positions is equal to a product of a number of magnetic elements provided on the rotatable rotary member and a number of magnetic elements provided on the stationary part.

3. The magnetic rotary actuator according to claim 1, wherein the at least two magnetic elements on the stationary part are arranged equidistantly to each other.

4. The magnetic rotary actuator according to claim 1, wherein the at least two magnetic elements on the rotatable rotary member have different distances from each other.

5. The magnetic rotary actuator according to claim 1, wherein more magnetic elements are provided on the stationary part than on the rotatable rotary member.

6. The magnetic rotary actuator according to claim 1, wherein adjacent magnetic elements on the rotatable rotary member have an angular distance from each other which is limited upwards by an angle which is calculated as follows $$\frac{360°}{N} + \frac{360°}{N^2},$$

which is limited downwards by an angle which is calculated as follows $$\frac{360°}{N} - \frac{360°}{N^2},$$

N being the number of magnetic elements on the rotatable rotary member.

7. The magnetic rotary actuator according to claim 1, wherein the stationary part is a magnetic housing which radially surrounds the rotatable rotary member.

8. The magnetic rotary actuator according to claim 1, wherein the magnetic elements are each formed by bar magnets or by at least one magnetic ring.

9. A motor vehicle control unit for a motor vehicle, comprising the magnetic rotary actuator of claim 1.

10. A magnetic rotary actuator for a motor vehicle control unit, comprising:

a stationary part;

a rotary member which is rotatable relative to the stationary part; and a magnetic latching haptics including a plurality of magnetic latching positions, wherein the stationary part and the rotatable rotary member each including at least two separately formed magnetic elements which generate the plurality of magnetic latching positions, and wherein a number of magnetic latching positions is equal to a product of a number of magnetic elements provided on the rotatable rotary member and a number of magnetic elements provided on the stationary part.

11. A magnetic rotary actuator for a motor vehicle control unit, comprising:

a stationary part;

a rotary member which is rotatable relative to the stationary part; and a magnetic latching haptics including a plurality of magnetic latching positions, wherein the stationary part and the rotatable rotary member each includes at least two separately formed magnetic elements which generate the plurality of magnetic latching positions, and wherein the at least two magnetic elements on the rotatable rotary member have different distances from each other.

* * * * *